US009341042B2

(12) United States Patent
Machina

(10) Patent No.: US 9,341,042 B2
(45) Date of Patent: May 17, 2016

(54) STOP LOSS TOOL FOR WELLHEADS

(71) Applicant: Richard Machina, Fort Worth, TX (US)

(72) Inventor: Richard Machina, Fort Worth, TX (US)

( * ) Notice: Subject to any disclaimer, the term of this patent is extended or adjusted under 35 U.S.C. 154(b) by 345 days.

(21) Appl. No.: 13/913,510

(22) Filed: Jun. 9, 2013

(65) Prior Publication Data

US 2014/0360716 A1 Dec. 11, 2014

(51) Int. Cl.

| | |
|---|---|
| ***E21B 33/072*** | (2006.01) |
| ***E21B 33/068*** | (2006.01) |
| ***E21B 33/076*** | (2006.01) |
| ***E21B 23/14*** | (2006.01) |

(52) U.S. Cl.

CPC ..... *E21B 33/072* (2013.01); *E21B 23/14* (2013.01); *E21B 33/068* (2013.01); *E21B 33/076* (2013.01)

(58) Field of Classification Search

CPC ..... E21B 33/068; E21B 33/072; E21B 23/14; E21B 33/076

See application file for complete search history.

(56) References Cited

U.S. PATENT DOCUMENTS

| | | | | |
|---|---|---|---|---|
| 2,350,863 | A * | 6/1944 | Bailey | E21B 40/00 166/70 |
| 2,710,064 | A * | 6/1955 | Osmun | 166/70 |
| 3,216,500 | A * | 11/1965 | Diehl | 166/70 |
| 3,435,895 | A | 4/1969 | Lee | |
| 3,444,928 | A * | 5/1969 | Pitts | 166/70 |
| 4,080,757 | A | 3/1978 | Westerman | |
| 4,211,279 | A | 7/1980 | Isaacks | |
| 4,629,004 | A | 12/1986 | Griffin | |
| 4,813,485 | A | 3/1989 | Coyle | |
| 5,148,867 | A | 9/1992 | Coyle | |
| 5,203,408 | A | 4/1993 | Boscher | |
| 5,282,319 | A | 2/1994 | Casquilho et al. | |
| 5,291,686 | A | 3/1994 | Sears et al. | |
| 5,791,712 | A | 8/1998 | Hawn | |
| 6,042,158 | A | 3/2000 | Horn | |
| 7,219,725 | B2 | 5/2007 | Chisholm | |
| 7,819,182 | B2 | 10/2010 | Adamek | |
| 2011/0297444 | A1 | 12/2011 | Kolev et al. | |
| 2012/0138312 | A1 * | 6/2012 | Strong | 166/377 |
| 2013/0233534 | A1 | 9/2013 | Trevino | |

FOREIGN PATENT DOCUMENTS

| | | |
|---|---|---|
| EP | 2156012 B1 | 8/2011 |
| GB | 1166590 A | 10/1969 |

OTHER PUBLICATIONS

International Search Report and Written Opinion in related International patent application No. PCT/US13/71542, mailed May 5, 2014, 8 pages.

International Search Report and Written Opinion in related International patent application No. PCT/US2014/041468, mailed Oct. 23, 2014, 7 pages.

* cited by examiner

*Primary Examiner* — Yong-Suk (Philip) Ro

(74) *Attorney, Agent, or Firm* — Law Office of Jeff Williams; J. Oliver Williams

(57) ABSTRACT

The present application includes a tool configured to prevent bidirectional passage through a pipe or wellhead. The tool includes at least a housing and a latch. The housing is coupled to the wellhead. The housing has an interior volume in communication with an interior volume of the wellhead through an aperture. The wellhead has a central axis. The latch is pivotally coupled to the interior of the housing and oriented so as to pivot within a plane parallel to the central axis. The latch is configured to selectively enter and exit the interior of the wellhead between a first orientation and a second orientation. The tool may further include a tube to be coupled in axial alignment with the wellhead or pipe.

20 Claims, 6 Drawing Sheets

STOP LOSS TOOL FOR WELLHEADS

BACKGROUND

1. Field of the Invention

The present application relates generally to a tool for preventing passage of equipment through a pipe, more particularly, to equipment for preventing the loss of equipment in a wellhead.

2. Description of Related Art

Gas and oil well pumping, swabbing, and drilling devices are used to remove oil and other substances from within an oil and gas well. Equipment is often lowered within a well to provide work, maintenance, and gather information about the well. Equipment is typically attached to a sandline and regulated by an operator. Once a desired work is performed, the equipment is raised to the surface.

Occasionally the sandline can break resulting in the equipment falling within the well. The process of retrieving the equipment can be very expensive, result in delays, and often stops production of the well. Liability for the costs typically depends on the location of the equipment when it breaks free from the sandline. Generally an operator is responsible for retrieving equipment that has fallen into the well bore once the equipment has passed the wellhead during removal.

Some devices have been used to try and mitigate the loss of equipment. Such devices focus on the equipment itself or on devices attached to the wellhead. Devices attached to the wellhead often use latches that move linearly.

Although great strides have been made, with respect to swabbing devices, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
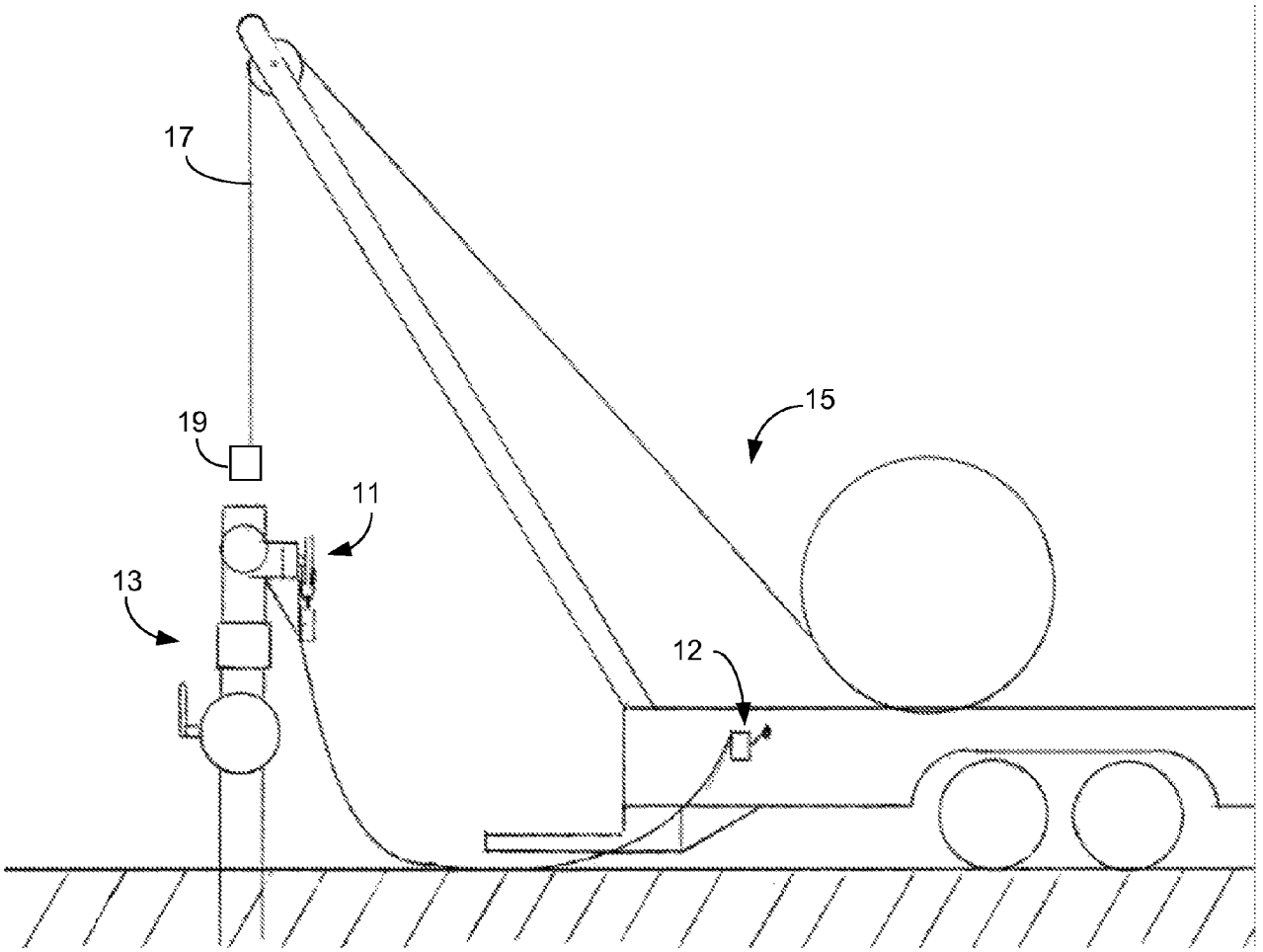
FIG. 1 is an view of a tool according to the present application in communication with a vehicle and a wellhead.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms, such as above and below, to describe a spatial relationship between various components or to describe the spatial orientation of aspects of such components should be understood to describe a relative relationship between the components or a spatial orientation of aspects of such components, respectively, as the device described herein may be oriented in any desired direction.

Referring now to FIG. 1 in the drawings, a tool 11 is illustrated. Tool 11 is coupled to a wellhead 13 used for the extraction of minerals from the earth (i.e. water, oil, gas and so forth). A vehicle 15 is shown in the vicinity of wellhead 13. Vehicle 15 includes that ability to operate a line (sandline) used for the transportation of equipment 19 within wellhead 13. Equipment 19 may be any type of device, typically used by an operator that is lowered into wellhead 13 to provide at least one of: service, drilling, maintenance, work, re-work, or provide data, concerning the status and functioning of the well.

It is understood that tool 11 may be used in any hollow shafted tube or pipe and is not limited to only wells or wellhead 13. Discussion of the features and benefits of tool 11 will be directed to its use with wellhead 13, but it is not so limited. Additionally, tool 11 may be configured in at least two separate ways. First, tool 11 may be coupled directly to the exterior surface of wellhead 13 or a pipe. Secondly, tool 11 may include tube 14 configured to be coupled to wellhead 13 or a pipe in an axial alignment. Description of the present application will focus on the first configuration wherein tool 11 is coupled to an exterior surface of a wellhead 13 or pipe. This is because tube 14 acts in similar form and function to that of wellhead 13. Therefore description of tool 11 is directed to the first configuration. When tube 14 is used, communication of tool 11 with wellhead 13 or the pipe occurs through tube 14 as opposed to housing 21. In either configuration, tool 11 is removable from wellhead 13 or a pipe.

Figure 2:
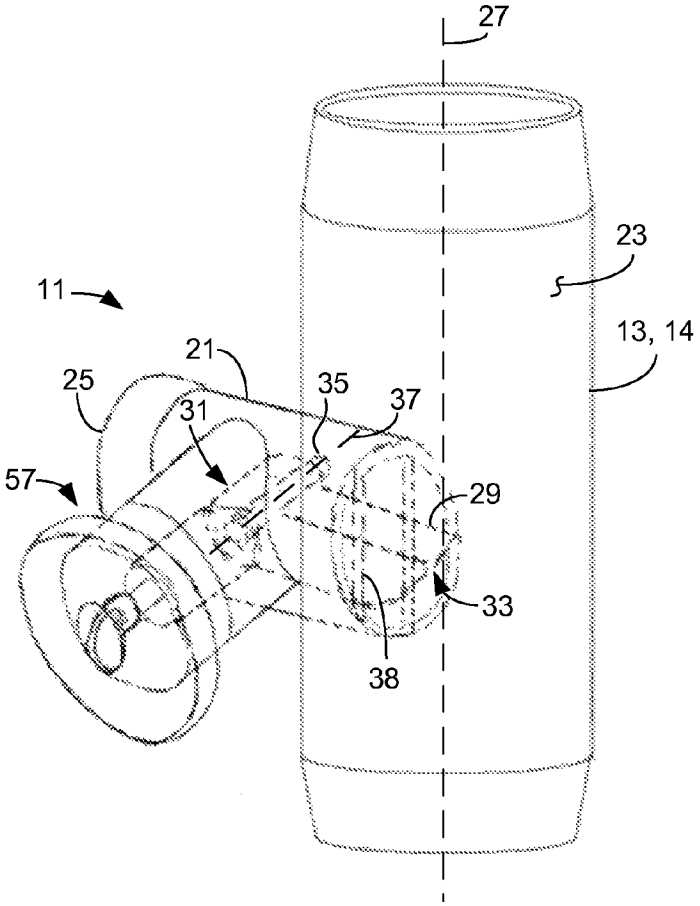
FIG. 2 is perspective view of the tool of FIG. 1.

Referring now also to FIG. 2 in the drawings, tool 11 is illustrated in communication with a portion of wellhead 13. Tool 11 includes a housing 21 coupled to wellhead 13 and a latch operably associated with both housing 21 and wellhead 13. Housing 21 extends away from an external surface 23 of wellhead 13 in a relatively perpendicular angle. It is understood that the angle housing 21 is not so limited and may be oriented other angles with respect to wellhead 13. Housing 21 defines an interior/interior volume within the interior walls of housing 21 and bound on the ends between a cap 25 and external surface 23. Wellhead 13 also defines an interior/interior volume as the space within external surface 23. Wellhead 13 defines a central axis 27 along its length.

Further included within tool 11 is a latch 29. Latch 29 is pivotally coupled to a portion of housing 21. Latch 29 has a pivot end 31 and a tip 33. Tip 33 is opposite pivot end 31. Adjacent pivot end 31 is a rotational device configured to secure latch 29 to housing 21 and to permit the rotation of latch 29 about a pivot axis 37. In this embodiment, the rotational device is a pin 35. However, it is understood that the rotational device is not so limited. The rotational device is any device which permits rotational movement of one body with respect to a second body. Pivot axis 37 is concentric with pin 35. Latch 29 passes through an aperture in wellhead 13, so as to permit tip 33 to extend into the interior volume of wellhead 13. Tool 11 is configured to selectively remove tip 33 from the interior volume of wellhead 13 by rotating latch 29.

Latch 29 is configured to rotate or pivot about pin 35 between a first orientation and a second orientation (see FIGS. 4A-5B). In doing so, latch 29 rotates along a plane that is parallel to central axis 27. Rotation about pin 35 permit latch 29 to selectively enter and exit the interior volume of wellhead 13. As described in more detail with FIGS. 4A-5B, latch 29 is configured to selectively restrict bidirectional travel of equipment within wellhead 13.

Figure 3:
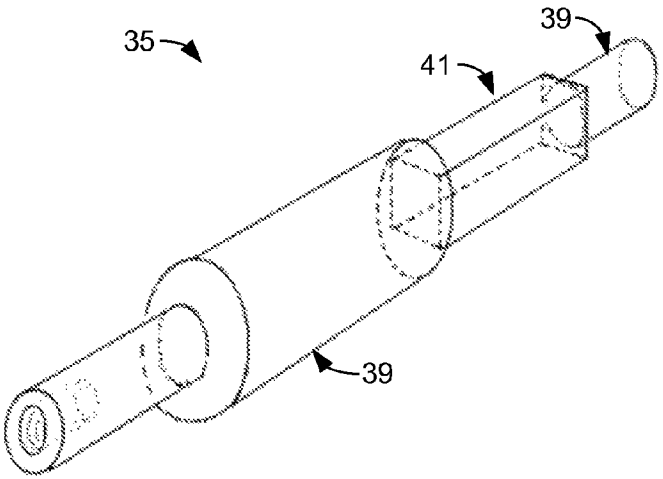
FIG. 3 is a rotational device used in the tool of FIG. 2.

Referring now also to FIG. 3 in the drawings, pin 35 is illustrated. Pin 35 is configured to have at least one radial portion 39 and at least one non-circular portion 41. Portion 41 is configured to pass through latch 29 and be of sufficient shape to cause latch 29 to rotate as pin 35 rotates. To do so, portion 41 must be non-circular as a whole, or maintain a selected number of ribs, teeth, or other gripping aides selectively located, so as to limit any slippage between pin 35 and latch 29. Portion 41 is illustrated as being rectangular in FIG. 3, but it is understood that portion 41 may take many shapes. For example, portion 41 may be shaped as an ellipse, rectangle, octagon, and so forth.

Radial portion 39 is configured to communicate directly with housing 21 to permit rotation of pin 35 relative to housing 21. Portion 39 is ideally circular. Whereas, portion 41 is configured to limit slippage, portion 39 is configured to promote slippage between pin 35 and housing 21. Pin 35 may utilize lubricant to promote slippage. Pin 35 protrudes through housing 21 to a handle assembly 57 (see FIGS. 6 and 7). Pin 35 and housing 21 are in sealing communication to prevent leakage of well fluid.

Pin 35 may be composed of a single unitary member having separate portions 39, 41 or may be composed of separate members interconnected with one another. Additionally, portion 39 in some embodiments may be a bearing that may be located along portion 41, so as to segregate portion 41 into two or more sections.

Figure 4B:
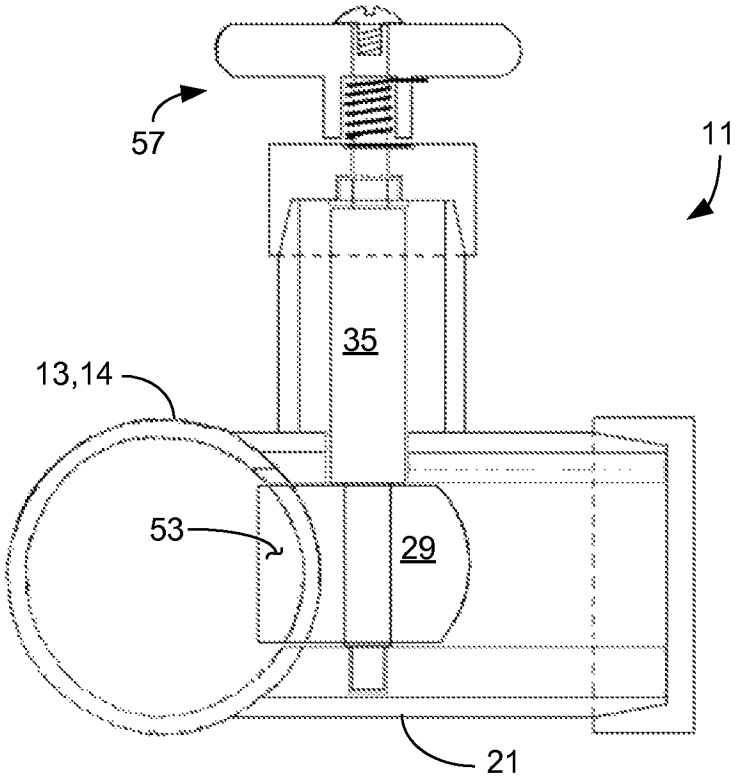
FIGS. 4A and 4B are a side view and top view of the tool of FIG. 2 showing a latch in a first orientation.
Figure 4A:
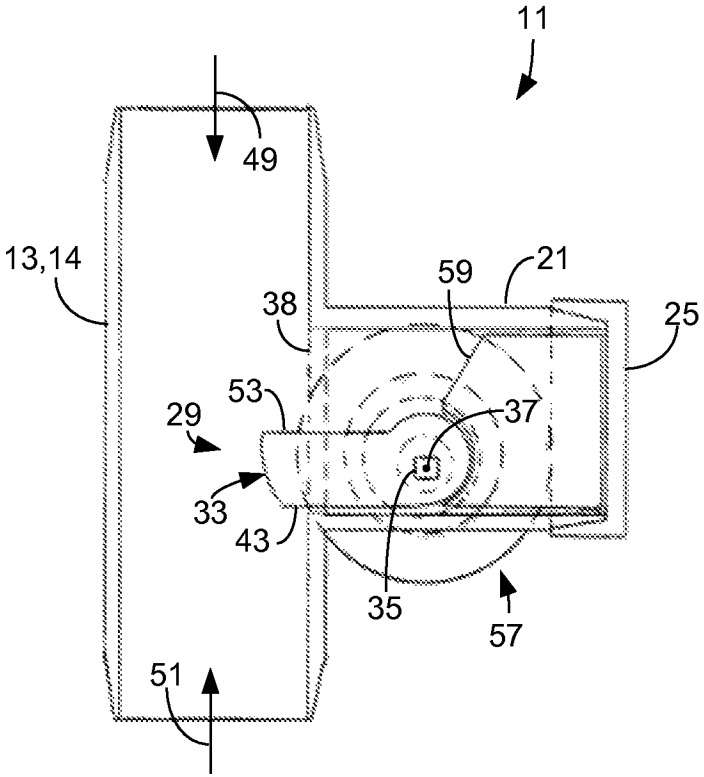
Figure 5B:
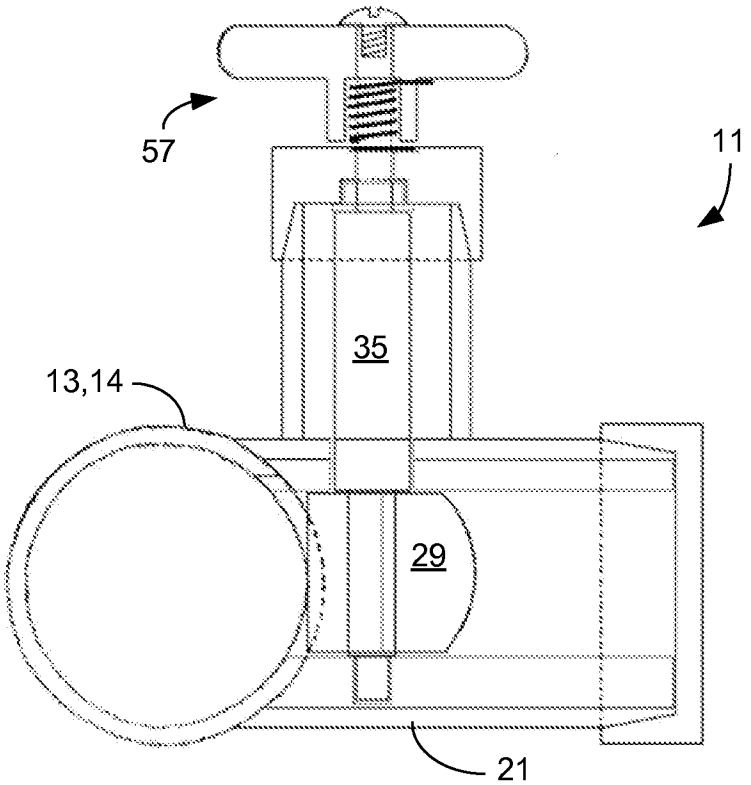
FIGS. 5A and 5B are a side view and top view of the tool of FIG. 2 showing the latch in a second orientation.

Referring now also to FIGS. 4A-5B in the drawings, latch 29 is illustrated between the first orientation and the second orientation. FIGS. 4A and 4B illustrate latch 29 in the first orientation and FIGS. 5A and 5B illustrate latch 29 in the second orientation. FIGS. 4A and 5A are side views of tool 11 while FIGS. 4B and 5B look downward through the well bore at latch 29. In the first orientation (FIGS. 4A and 4B), latch 29 is parallel with housing 21. Tip 33 extends out within the internal volume of wellhead 13. A lower surface 43 of latch 29 rests adjacent to surface 45 of aperture 38. Surface 43 may either rest on, and contact, surface 45 or may be configured to remain gapped from surface 45. Specific design constraints may warrant one approach over another. Surface 45 is configured to prevent the rotation of latch 25 beyond a perpendicular orientation with central axis 27. Surface 45 is configured to prevent the over rotation of latch 29 beyond the first orientation.

Figure 5A:
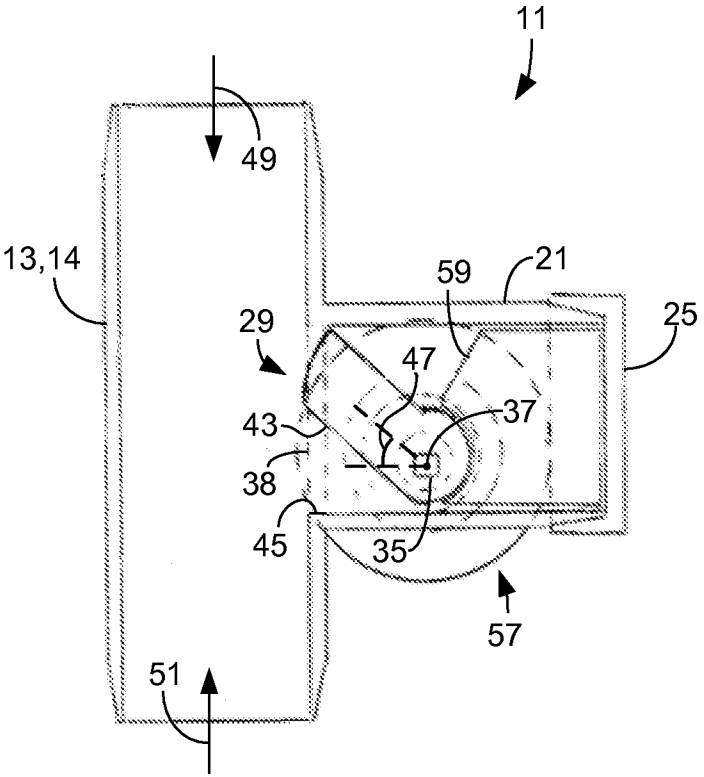

As seen in FIGS. 5A and 5B, latch 29 is positioned in the second orientation. In such an orientation, tip 33 is removed from the interior volume of wellhead 13. Latch 29 is entirely within the interior volume of housing 21. It is understood that design constraints may vary the degree to which latch 29 rotates between the interior volumes of wellhead 13 and housing 21. In the second orientation, tip 33 may contact housing 21 to act as a stop feature; however, such a feature is optional. It is understood that tool 11 may be configured to prevent the over rotation of latch 29 beyond the second orientation by using contact with housing 21, wellhead 13, or another member in communication with housing 21 and/or wellhead 13. The degree to which latch 29 is able to rotate is defined by angle 47. It is preferred that angle 47 is less than ninety degrees.

As stated previously, tool 11 is configured to selectively prevent bidirectional travel of equipment 19 through wellhead 13. As stated differently, tool 11 is configured to selectively permit the uni-directional passage of equipment 19 through wellhead 13. During operation of a well, equipment is lowered into the well and then removed. Line 17 is coupled to equipment 19 to regulate the position and velocity of equipment 19 in the well. Occasions arise wherein the connection between line 17 and equipment 19 is broken, resulting in the dropping of equipment 19. Retrieval of equipment 19 in the well can be expensive and create delays.

Tool 11 is configured to selectively permit that passage of equipment and fluid passed latch 29. Equipment 19 may travel in one of two directions in the well: a first direction denoted by arrow 49 (downward direction); and a second direction denoted by arrow 51 (upward direction). First, it is noted that equipment 19 typically has a diameter similar in size to that of the well bore (internal diameter of the well). Some variations may exist. Latch 29 is configured to extend into the internal volume of wellhead 13 sufficiently in the first orientation to selectively restrict the passing of equipment 19.

When lowering (arrow 49) equipment 19 through wellhead 13, latch 29 is raised to the second orientation. The second orientation permits latch 29 to exit the interior volume of wellhead 13 sufficiently to permit the lowering of equipment 19 below tool 11. While raising (arrow 51) equipment 19, latch 29 and equipment 19 come into contact, and the upward forces lifting equipment 19 induce an upward force on latch 29 sufficient to rotate latch 29 about pivot axis 37. In doing so, latch 29 rotates from the first orientation to the second orientation. Once equipment 19 has passed latch 29, latch 29 returns to the first orientation.

An advantage of the present rotatable latch 29 is the ability to generate less drag forces against equipment 19 when rising passed latch 29. Tip 33 is contoured to assist in transferring the vertical forces applied by equipment 19 to a rotational force applied to latch 29. It is understood that latch 29 may optionally be rotated to the second orientation prior to contact with equipment 19 similar to that done when equipment 19 was lowered.

Once equipment 19 is raised beyond latch 29, latch 29 returns to the first orientation. In this position, if equipment 19 were to break free from line 17 or drop unexpectedly, equipment 19 would contact latch 29 along an upper surface 53 and cease downward travel. Tool 11 prevents the loss of equipment 19 within the well, thereby saving time, money, resources, and production.

Figure 7:
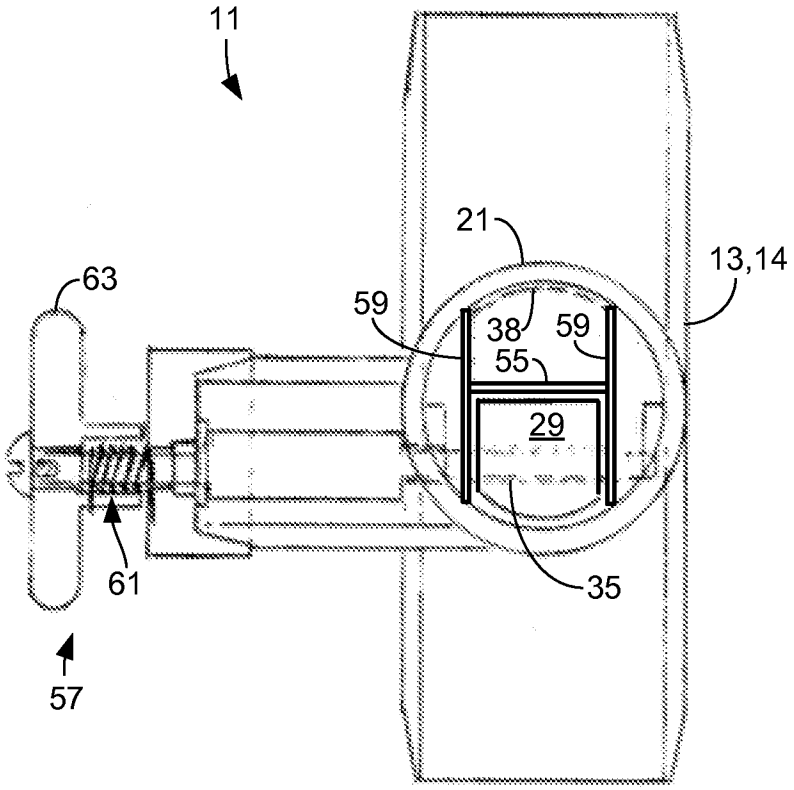
FIG. 7 is a side view of the tool of FIG. 2 looking into the housing from an end opposite the wellhead.
Figure 6:
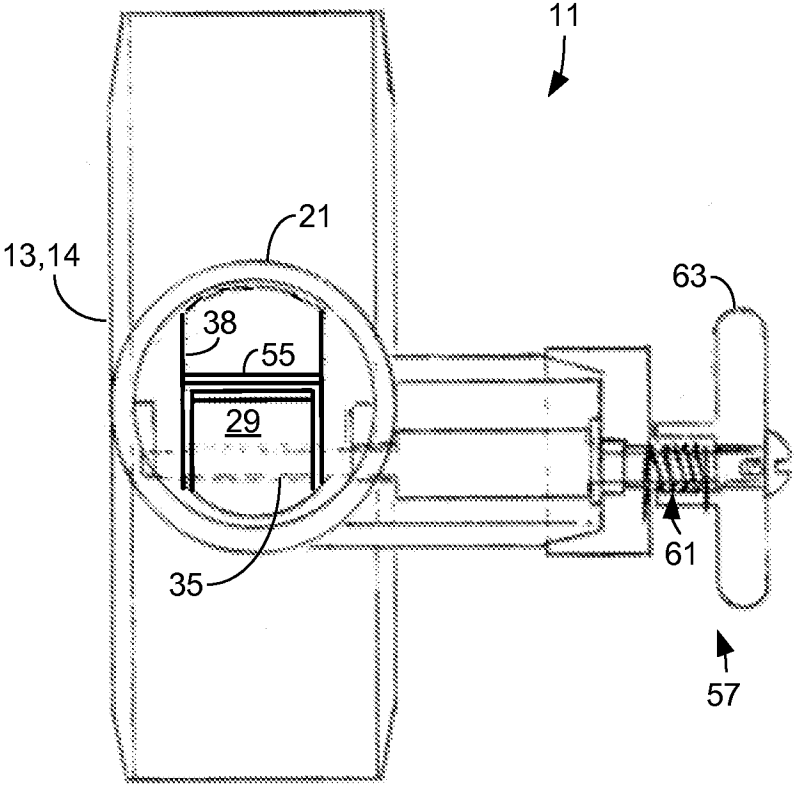
FIG. 6 is a side view looking into a housing of the tool of FIG. 2 from the wellhead.

Referring now also to FIGS. 6 and 7 in the drawings, additional views of tool 11 are illustrated in a first orientation, specifically showing a stop 55 and the operations of a handle assembly 57. FIG. 6 is a side view looking from wellhead 13 into housing 21. FIG. 7 is a side view looking from cap 25 toward wellhead 13, with cap 25 removed. Stop 55 is configured to prevent rotation of latch 29 passed the first orientation. To illustrate, as equipment 19 falls and makes contact with upper surface 53, considerable forces are transferred to latch 29. Tip 33 of latch 29 is cantilevered into the interior volume of wellhead 13. When forces act on tip 33, a pivot point may occur where aperture 38 and latch 29 contact. The pivot point results in an upward force being applied to pin 35. In instances where the forces are great enough to induce failure of pin 35, latch 29 may rotate passed first orientation in a counter-clockwise direction, wherein pivot end 31 rises within housing 21. If such an event occurred, latch 29 may fail and permit equipment 19 to continue to fall in the well.

Stop 55 is a barrier or additional piece of material located above pivot end 31. In this embodiment, stop 55 extends between two latch supports 59 affixed to housing 21 to secure and support the rotational device, such as pin 35. If pin 35 fails, pivot end 31 is configured to contact stop 55 and prevent counter-clockwise rotation of latch 29. In other embodiments, stop 55 may be configured to prevent the translation of latch 29 within housing 21 if pin 35 failed. Stop 55 is configured to maintain the position of latch 29 during failure of the rotational device. Stop 35 may be formed from one or more members or elements. Furthermore, other embodiments may secure stop 55 directly to housing 21 as opposed to supports 59.

Handle assembly 57 is configured to provide a user or operator control of the orientation of latch 29 in tool 11. Handle assembly may be manually operated and/or remotely operated. As mentioned previously, latch 29 is biased toward the first orientation. The biasing of latch 29 may be done by any type of biasing element: spring or motor for example. In the present application, the biasing element is spring 61. As forces are applied that induce rotation of latch 29 from the first orientation to the second orientation, tension in spring 61 increases, when the forces applied, spring 61 is configured to pivot latch 29 back to the first orientation. The forces may be a result of equipment 19 rising within the well or through fluid pressure and/or fluid passing around latch 29. If spring 61 or any other biasing element were not used, the passing of fluid may change the orientation of latch 29. Handle assembly 57 further includes a handle 63. Handle 63 is configured to permit manual operation of latch 29. Handle 63 is not so limited as to being a circular member having an axis in axial communication with pin 35. Handle 63 may be a lever for example.

Figure 9:
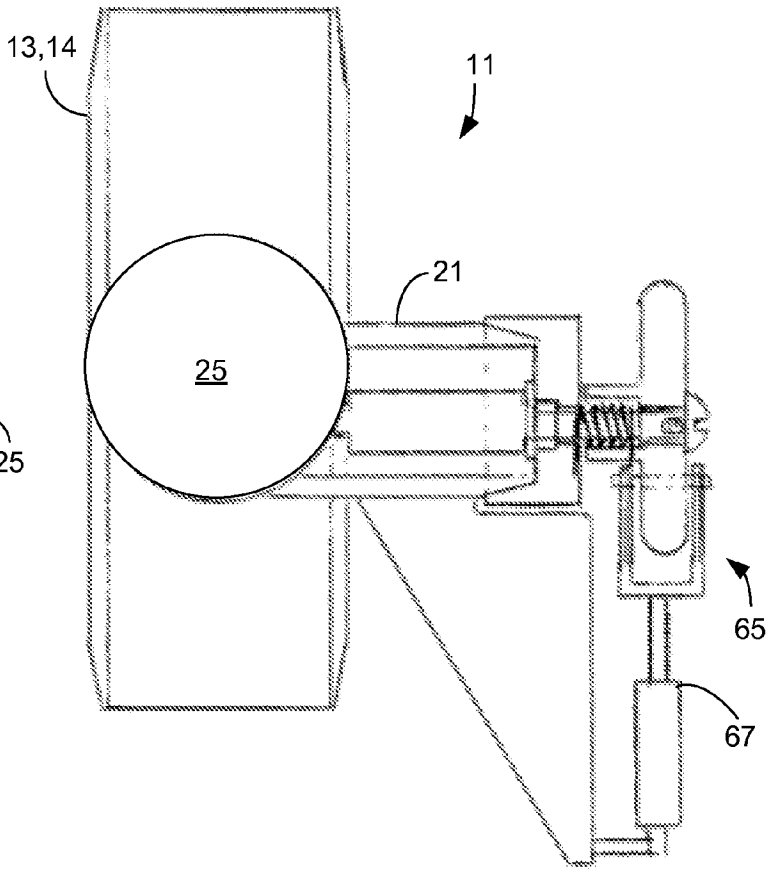
FIGS. 8 and 9 are side views of an alternative embodiment of the tool of FIG. 2, wherein a drive unit provides automated control.
Figure 8:
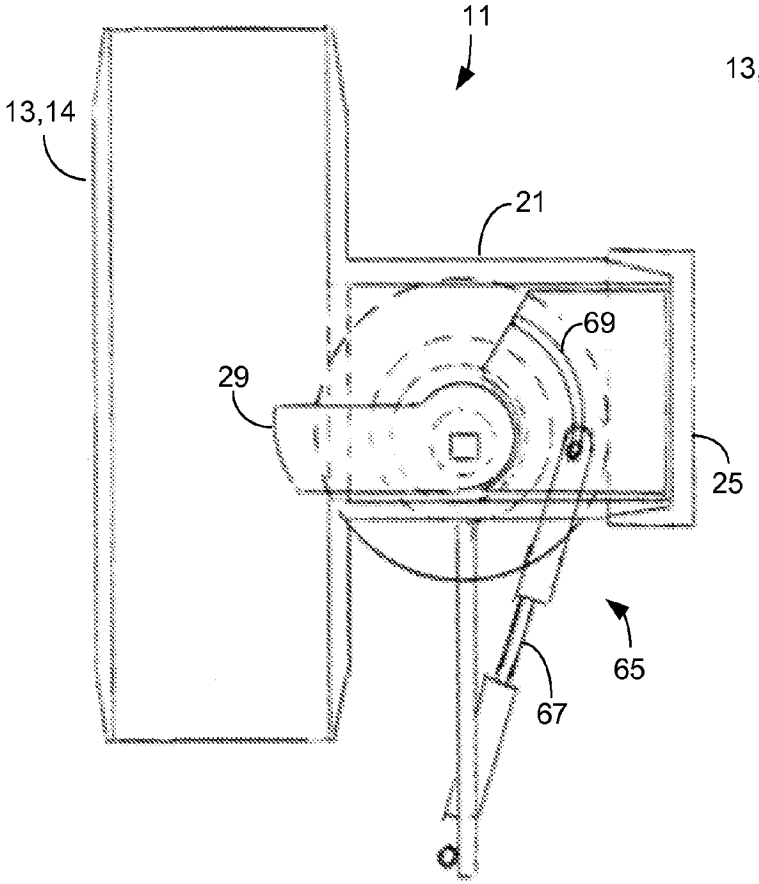

Referring now also to FIGS. 8 and 9 in the drawings, an alternative embodiment of handle assembly 57 is illustrated. As stated above, handle assembly 57 may be manually and/or remotely operated. FIGS. 8 and 9 illustrate an exemplary embodiment of handle assembly 57 in which both manual operation and remote operation (through automated controls) of latch 29 are permitted. Handle assembly 57 further includes an automated drive unit 65. Drive unit 65 may be any one of an electronic device, pneumatic device, magnetic device, an electro-magnetic device, and/or hydraulic device used to allow an operator control of latch orientation from a location remote of tool 11. For example, as seen in FIG. 1, tool 11 may be in communication with vehicle 15 having a remote operation panel 12 to operate tool 11. Furthermore, tool 11 may use wireless communications to transmit and receive data to adjust the orientation of latch 29 through drive unit 65.

In FIGS. 8 and 9, a solenoid 67 is seen in communication with handle 63. Drive unit 65 is coupled to handle 63. Handle 63 includes a track 69 configured to accept a portion of drive unit 65. Drive unit 65 is able to translate within track 69. As seen in FIG. 8, when latch 29 is in the first orientation, drive unit 65 is located in the lower portion of track 69. In order to induce an orientation change of latch 29 via automated controls (drive unit 65), drive unit 65 rotates handle 63 in a clockwise direction as seen from the view of FIG. 8. Drive unit 65 induces a force in opposition to that of the biasing element. Drive unit 65 may selectively secure latch 29 in the second orientation, or any point between. To return latch 29 to the first orientation, drive unit 65 releases the applied force on handle 63, thereby allowing the biasing element to return latch 29 to the first orientation. Drive unit 65 is configured to control the rate of speed of latch 29 when rotating.

Manual operation is also permitted when using drive unit 65. An operator may induce a clockwise rotation of handle 63, during which drive unit 65 maintains the same relative position to housing 21 but translates within track 69 toward the upper end of track 69. The biasing element returns latch 29 to the first orientation, in which handle then rotates in a counter-clockwise direction and drive unit 65 translates to the lower end of track 69. Although described as using track 69, handle 63 and drive unit 65 may couple together in other ways that permit the selective operation of latch 29 between an automated and manual operation. An advantage of having automated and manual control of latch 29 is that automated operation of latch 29 may be overridden by the manual controls.

It is understood that other embodiments may utilize only automated operation to permit remote control. Where automated operation is the sole source of operational control of latch 29, handle 63 is removed and drive unit 65 is coupled to the rotational device, such as pin 35.

Cap 25 is in communication with housing 21, preferably on an end opposite wellhead 13. Cap 25 is removable to permit maintenance and inspection of the elements within housing 21. By being perpendicular to the axis of housing 21, ease of access to every portion within housing 21 is simplified.

The current application has many advantages over the prior art including the following: (1) ability to rotate about an axis to selectively protrude into a hollow shaft; (2) compact and simple design unaffected by pressure in the hollow shaft; (3) simple to manufacture; (4) decreased friction force in rotating a latch as opposed to translating. one-way passing of a swabbing tool; and (5) ability to clean, maintain, and service the latching and biasing member without removing them from the housing.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A tool for a wellhead, comprising:

a housing coupled to the wellhead, an interior of the housing in communication with an interior of the wellhead, the wellhead having a central axis; and a latch pivotally coupled to the interior of the housing, the latch oriented so as to pivot within a plane parallel to the central axis, the latch configured to selectively enter and exit the interior of the wellhead between a first orientation and a second orientation;

wherein the latch selectively restricts bidirectional travel of equipment in the wellhead, the latch configured to rotate from the first orientation to the second orientation as a result of contact with the equipment as the equipment passes the latch, the latch configured to return to the first position after the equipment passes irrespective of the position of the equipment beyond the latch.

2. The tool of claim 1, wherein the latch is manually operated between the first orientation and the second orientation.

3. The tool of claim 1, wherein operation of the latch between the first orientation and the second orientation is automated.

4. The tool of claim 3, wherein the automation is performed through at least one of an electronic, a pneumatic, an electro-magnetic, and a hydraulic device.

5. The tool of claim 3, wherein the automated operation of the latch between the first orientation and the second orientation can be manually overridden.

6. The tool of claim 1, wherein the latch protrudes into the wellhead in the first orientation and is removed from the wellhead when pivoting to the second orientation; and wherein a biasing member biases the latch to the first orientation.

7. The tool of claim 6, wherein the biasing member is a spring.

8. The tool of claim 6, wherein the latch is configured to be selectively secured in the second orientation.

9. The tool of claim 1, further comprising:

a stop in communication with the housing adjacent a pivot axis of the latch, the stop configured to maintain the position of the latch during failure of a rotational device, the latch configured to pivot about the rotational device.

10. The tool of claim 1, further comprising:

a cap removeably coupled to the housing to permit access to the latch.

11. A tool for restricting passage within a hollow shaft, comprising:

a tube coupled to the hollow shaft such that the tube and the hollow shaft are in axial alignment, the tube having an interior volume and the hollow shaft having an interior volume, the tube having a central axis, a housing coupled to the tube, the tube and the housing in a non-collinear orientation, an interior volume of the housing in communication the interior volume of the tube; and a latch pivotally coupled within the interior volume of the housing, the latch oriented so as to pivot within a plane parallel to the central axis, the latch configured to selectively rotate between a first orientation and a second orientation;

wherein the latch selectively permits unidirectional travel through the tube, the latch configured to rotate from the first orientation to the second orientation as a result of contact with the equipment as the equipment passes the latch, the latch configured to return to the first position after the equipment passes irrespective of the position of the equipment beyond the latch.

12. The tool of claim 11, wherein the latch is manually operated between the first orientation and the second orientation.

13. The tool of claim 11, wherein operation of the latch between the first orientation and the second orientation is automated.

14. The tool of claim 13, wherein the automation is performed through at least one of an electronic, a pneumatic, an electro-magnetic, and a hydraulic device.

15. The tool of claim 13, wherein the automated operation of the latch between the first orientation and the second orientation can be manually overridden.

16. The tool of claim 11, wherein the latch protrudes within the interior volume of the tube in the first orientation and withdraws from the interior volume of the tube in the second orientation; and wherein a biasing member biases the latch to the first orientation.

17. The tool of claim 16, wherein the biasing member is a spring.

18. The tool of claim 11, further comprising:

a stop in communication with the housing adjacent a pivot end of the latch, the stop configured to maintain the position of the latch during failure of a rotational device, the latch configured to pivot about the rotational device.

19. The tool of claim 11, further comprising:

a cap removably coupled to the housing to permit access to the latch.

20. The tool of claim 11, wherein the tube is removable from the hollow shaft.

* * * * *